US009255471B2

(12) United States Patent
Andrzejak et al.

(10) Patent No.: US 9,255,471 B2
(45) Date of Patent: Feb. 9, 2016

(54) ENCAPSULATED EXPLOSIVE PELLET

(71) Applicant: Schlumberger Technology Corporation, Sugar Land, TX (US)

(72) Inventors: Timothy Al Andrzejak, Sugar Land, TX (US); Jorge E. Lopez De Cardenas, Sugar Land, TX (US); Gary L. Rytlewski, League City, TX (US); Carlos Abad, Richmond, TX (US); Javier Sanchez Reyes, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 377 days.

(21) Appl. No.: 13/708,592

(22) Filed: Dec. 7, 2012

(65) Prior Publication Data

US 2014/0158356 A1 Jun. 12, 2014

(51) Int. Cl.

| | |
|---|---|
| ***E21B 43/26*** | (2006.01) |
| ***E21B 43/263*** | (2006.01) |
| ***F42B 3/00*** | (2006.01) |
| ***F42D 1/10*** | (2006.01) |

(52) U.S. Cl.

CPC ..... *E21B 43/263* (2013.01); *F42B 3/00* (2013.01); *F42D 1/10* (2013.01)

(58) Field of Classification Search

CPC ..... E21B 43/26; E21B 43/267

See application file for complete search history.

(56) References Cited

U.S. PATENT DOCUMENTS

| | | | | |
|---|---|---|---|---|
| 3,948,176 | A * | 4/1976 | Koomen | 102/204 |
| 4,557,771 | A | 12/1985 | Bencz et al. | |
| 5,945,627 | A | 8/1999 | Arpin et al. | |
| 7,134,492 | B2 | 11/2006 | Willberg et al. | |
| 8,163,826 | B2 | 4/2012 | Willberg et al. | |
| 2004/0226715 | A1 * | 11/2004 | Willberg et al. | 166/250.1 |
| 2007/0036977 | A1 | 2/2007 | Sinclair et al. | |
| 2013/0032337 | A1 | 2/2013 | Rytlewski et al. | |

* cited by examiner

*Primary Examiner* — William P Neuder

(74) *Attorney, Agent, or Firm* — Jeffery R. Peterson

(57) ABSTRACT

An apparatus usable with a well includes an explosive pellet that is adapted to be communicated into the well via a fluid and includes an explosive material that is adapted to be detonated downhole in the well. The apparatus further includes an encapsulant to encapsulate the explosive pellet to inhibit unintended detonation of the explosive material. The encapsulant is adapted to be at least partially removed from the explosive pellet in response to the explosive pellet being communicated into the well.

22 Claims, 6 Drawing Sheets

ENCAPSULATED EXPLOSIVE PELLET

BACKGROUND

For purposes of enhancing the production of a hydrocarbon (oil or gas) from a hydrocarbon-bearing reservoir, a hydraulic fracture operation may be conducted to induce fractures in the reservoir rock. With hydraulic fracturing, a fracturing fluid is pumped downhole to create a downhole hydraulic pressure that causes a network of fractures to form in the reservoir rock. A fracture pack (proppant, for example) may be communicated downhole with the fracturing fluid for purposes of depositing the pack inside the fractures to hold the fractures open when the hydraulic pressure is released. To observe the progress, geometry and extent of an ongoing fracturing operation, hydraulic fracture monitoring (HFM) may be employed. With passive micro-seismic HFM, an array of geophones may be deployed on the surface, in a neighboring well or in the well to be fractured and used to map microseismic events, which are created by the fracturing process.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In an example implementation, an apparatus usable with a well includes an explosive pellet that is adapted to be communicated into the well via a fluid and includes an explosive material that is adapted to be detonated downhole in the well. The apparatus further includes an encapsulant to encapsulate the explosive pellet to inhibit unintended detonation of the explosive material. The encapsulant is adapted to be at least partially removed from the explosive pellet in response to the explosive pellet being communicated into the well.

In another example implementation, a technique that is usable with a well includes pumping a fluid into the well to communicate an explosive pellet into the well and detonating the explosive pellet downhole in the well. The technique includes using an encapsulant to encapsulate the explosive pellet to inhibit unintended detonation of the explosive material; and at least partially removing the encapsulant in response to communicating the explosive pellet into the well.

In yet another example implementation, a technique that is usable with a well includes providing a device adapted to launch ball sealers into the well and encapsulating an explosive pellet with an encapsulant to cause the encapsulated explosive pellet to have a form factor that is substantially the same as a ball sealer form factor. The technique includes using the device to communicate the explosive pellet into the well.

Advantages and other features will become apparent from the following drawings, description and claims.

DETAILED DESCRIPTION

Figure 1:
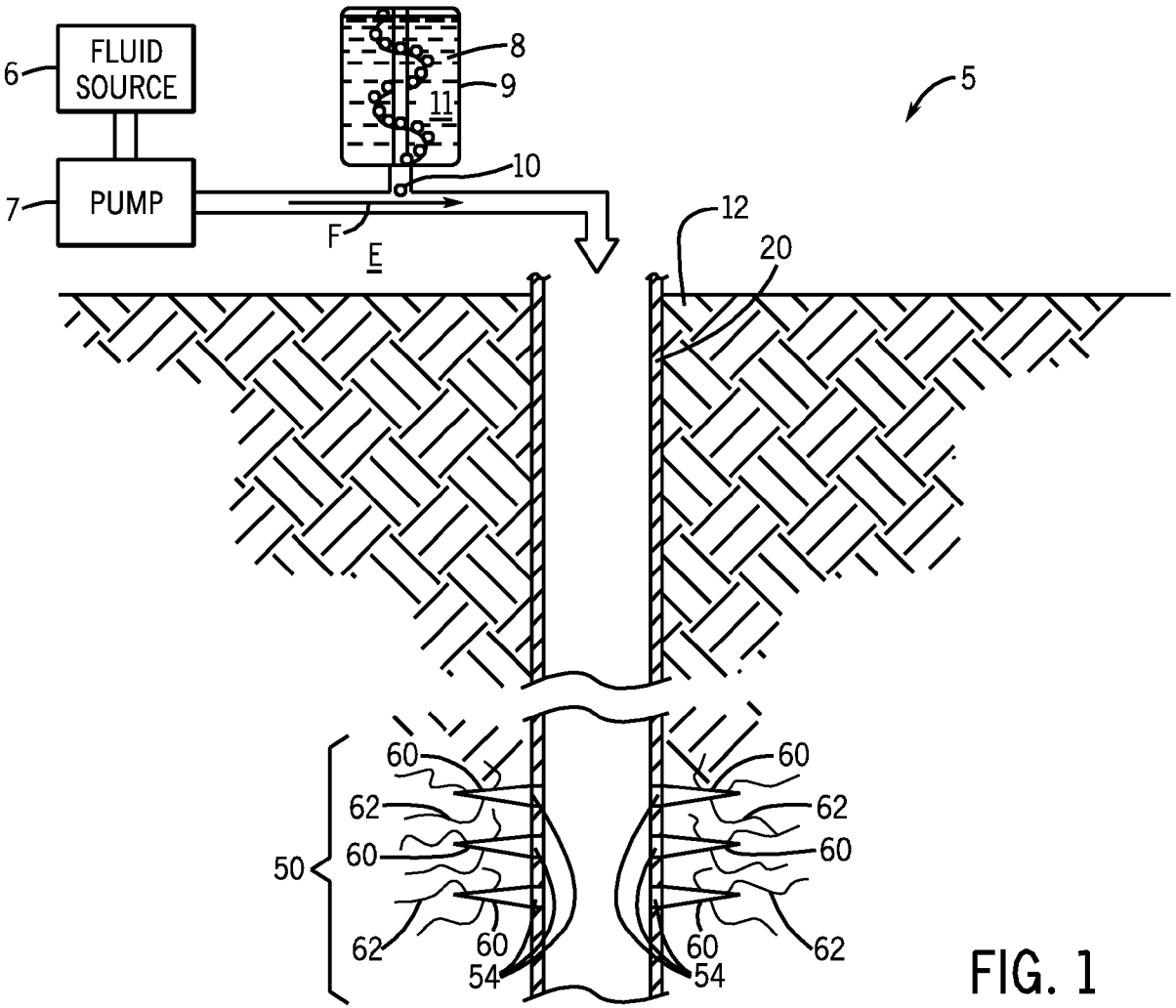
FIG. 1 is a schematic diagram of a well system according to an example implementation.

In the following description, numerous details are set forth to provide an understanding of features of various embodiments. However, it will be understood by those skilled in the art that the subject matter that is set forth in the claims may be practiced without these details and that numerous variations or modifications from the described embodiments are possible.

As used herein, terms, such as "up" and "down"; "upper" and "lower"; "upwardly" and downwardly"; "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

Although passive micro-seismic hydraulic fracture monitoring (HFM) may be relatively useful in providing information about the geometry and extent of fractures, the resolution and overall quality of the HFM data may be enhanced, in accordance with example implementations disclosed herein, through the use of relatively small explosive pellets that are pumped into the fractures. More specifically, systems and techniques are disclosed herein for purposes of encapsulating an explosive pellet and deploying the encapsulated explosive pellet in a well. The encapsulated explosive pellet may be used to enhance HFM, as well as be used for other purposes, such as stimulating the well, providing a triggering mechanism for other devices, functioning as acoustic sources, etc. For the specific example application of HFM, increased accuracy may be achieved in HFM by introducing explosive pellets into the fractures that are created by the hydraulic fracturing and monitoring the acoustic energies (using geophones, for example) generated by the pellets when they explode. As examples, the explosive pellets may be constructed to be detonated downhole by the temperatures and/or stresses in the downhole environment, such as the stresses or temperatures that are experienced inside the downhole fracture network.

As disclosed herein, the explosive pellets are encapsulated, which imparts certain safety characteristics. In this manner, the encapsulation mitigates, if not prevents, unintended stresses on the pellets during the handling, storage, transportation and conveyance into the well of the pellets, which have the potential of causing unintended pellet detonation. The encapsulation also enhances deployment of the explosive pellets into the well, as the encapsulation may be used to transform the form factor of the explosive pellet to the form factor of a ball sealer or other convenient shape, thereby allowing the use of a conventional ball sealer launcher or similar devices to deploy encapsulated explosive pellets into the well. Moreover, as disclosed herein, the encapsulant is constructed to be readily removed, or released, when the explosive pellet is released into the well or at least when the downhole pellet approaches the fracture network, for purposes of allowing the encapsulation to provide the aforementioned storage, transportation and delivery features, as well as allow the pellet to perform its intended downhole function.

Turning now to a more specific example of the use of encapsulated explosive pellets for HFM, referring to FIG. 1, a well system 5 includes a wellbore 12 that extends into a particular example zone, or stage 50, which has been perforated (as shown by perforation tunnels 60) and fractured to some degree (as shown by exemplary fractures 62). The well system 5 may include HFM monitoring equipment (not shown in FIG. 1) for purposes of monitoring the progress of the hydraulic fracturing. More specifically, as depicted in FIG. 1, the fracturing fluid may be pumped directly into the wellbore 12 through the central passageway of a casing string 20, and encapsulated explosive pellets 10 may be communicated with the fracturing fluid into the perforated zone of the well 50. In an alternate scenario, the hydraulic fracturing fluid and the encapsulated explosive pellets may be communicated into the wellbore 12 through a tubing string (not depicted in FIG. 1) that extends from the Earth surface E to a position just above the perforated zone of the well 50.

For this example, the wellbore 12 is "cased," or lined by the casing string 20, which supports the wellbore 12. To this end, the casing string 20 includes perforation openings 54 that correspond to the perforation tunnels 60 and may be formed by the shaped charge perforation jets (produced by a perforating gun) that form the tunnels 60. In further implementations, the casing string 20 may pre-perforated; may have sleeve valves that are opened to establish hydraulic communication; or may be formed using an abrasive fluid jetting tool. In another example, the well could be open-hole in the zone of interest.

As depicted in FIG. 1, the explosive pellets 10 may be communicated into the well (via directly through the casing, for example, or through a central passageway of tubing string positioned from the surface to just above the perforated zone of the well 50) by pumping a fracturing fluid supplied by a fluid source 6 (at the Earth surface E) via an Earth surface E-disposed pump 7. For this example, in preparation to be delivered into the well, the encapsulated explosive pellets 10 are stored at the Earth surface E inside a ball sealer launcher 9, which is constructed to be operated to deliver the pellets 10 into the well. In this manner, as further disclosed herein, in accordance with example implementations, the encapsulated explosive pellet 10 has a form factor (i.e., dimensions, or geometry) that corresponds to the form factor of a ball sealer (e.g., the encapsulated explosive pellet 10 has outer dimensions and geometry that are consistent with the outer dimensions of a ball sealer), and as such, a conventional ball sealer launcher 9, or another device that is constructed to deliver, or launch objects having a given form factor that differs from the form factor (i.e., the outer dimensions) of the inner pellet, may be used for purposes of deploying the encapsulated explosive pellets 10 into the well, in accordance with example implementations.

As shown in FIG. 1, in accordance with example implementations, the ball sealer launcher 9, or an equivalent device, is disposed downstream from the pump 7 so that the deployed encapsulated explosive pellets 10 (deployed in a flow F downstream of the pump 7) are not communicated through the flow path of the pump 7. When deployed into the well, the encapsulated explosive pellets 10 travel downhole, for example, are communicated into the well through the casing 20 or through a central tubing string positioned from the surface to just above the perforated zone of the well 50, the encapsulating materials are removed, the inner explosive pellets are translated to the perforated zone of the well 50, and the explosive pellets follow the fluid flow lines into the perforation tunnels 60.

Figure 2:
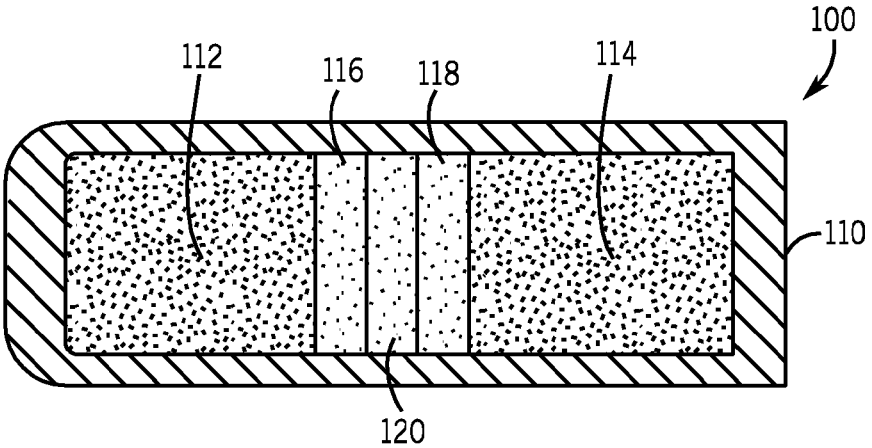
FIG. 2 is a schematic cross-sectional view of an explosive pellet according to an example implementation.
Figure 3:
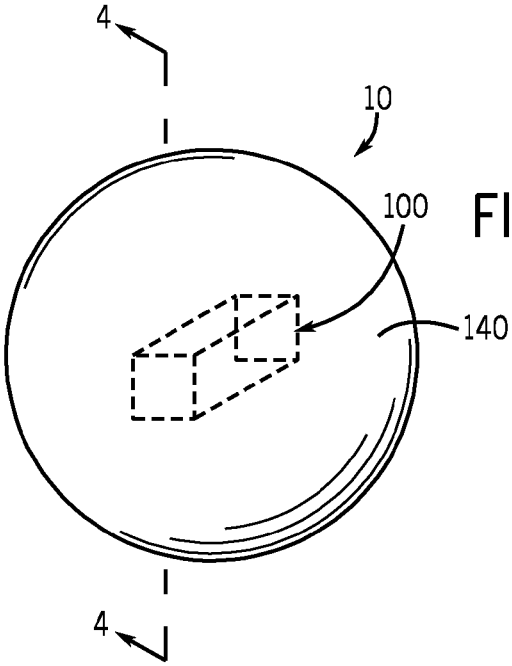
FIG. 3 is a perspective view of an encapsulated explosive pellet according to an example implementation.

Referring to FIG. 3, in accordance with an example implementation, the encapsulated explosive pellet 10 includes an inner, elongated explosive pellet 100, which is surrounded by an encapsulant 140 that imparts a generally spherical shape (as an example) for the encapsulated explosive pellet 10. Referring to FIG. 2 in conjunction with FIG. 3, in accordance with an example implementation, the inner explosive pellet 100 may be formed from an explosive casing, or housing 110, which contains, for example, an initiator 120 and secondary explosives 116 and 118 which are disposed on either side of the initiator 120.

The housing 110 of the explosive pellet 100 may be made of any suitable material including metals and metal alloys, such as stainless steel, aluminum, or the like. As depicted in FIG. 2, the housing 110 may be elongated in the general form of an open circular cylinder (as an example) that is closed by an end cap; and the housing 110 may have a length ranging from a low of about 0.5 centimeters (cm), about 1.0 cm, about 1.5 cm, or about 2.0 cm to a high of about 2.5 cm, about 3.0 cm, about 4.0 cm, about 5.0 cm, or more. For example, the length can be about 2.5 cm to about 4.0 cm. The housing 110 may have an outer cross-sectional diameter ranging from a low of about 0.3 cm, about 0.6 cm, about 0.7 cm, about 0.8 cm, or about 0.9 cm to a high of about 1.1 cm, about 1.2 cm, about 1.3 cm, about 1.4 cm, about 1.5 cm, or more. For example, the outer diameter of the housing 110 may be about 0.7 cm to about 1.0 cm. The housing 110 may have an inner cross-sectional diameter ranging from a low of about 0.2 cm, about 0.4 cm, about 0.5 cm, about 0.6 cm, or about 0.7 cm to a high of about 0.8 cm, about 0.9 cm, about 1.0 cm, about 1.1 cm, about 1.2 cm, or more. For example, the inner diameter may be about 0.5 cm to about 0.7 cm. Accordingly, the thickness of the wall of the housing 110 may range from a low of about 0.025 cm, about 0.05 cm about 0.1 cm, or about 0.2 cm to a high of about 0.3 cm, about 0.4 cm, about 0.5 cm, or more. For example, the thickness of the wall of the housing 110 can be about 0.05 cm to about 0.2 cm.

When the housing 110 is sufficiently stressed in the downhole environment, the effect of the resulting stress ignites the initiator 120 of the pellet 100, which causes the initiator 120 to burn and build up a sufficient pressure to initiate the secondary explosives 116 and 118. The initiations of the secondary explosives 116 and 118, in turn, initiate corresponding adjacent primary explosives 112 and 114. It is noted that the explosive pellet 100 that is depicted in FIG. 2 is merely an example, as other designs of the explosive pellet may be used, in accordance with further implementations. Details of various example implementations for the explosive pellet may be found, in, for example, U.S. patent application Ser. No. 13/485,546, entitled, "EXPLOSIVE PELLET," which was filed on May 31, 2012, and is hereby incorporated by reference in its entirety.

Figure 4:
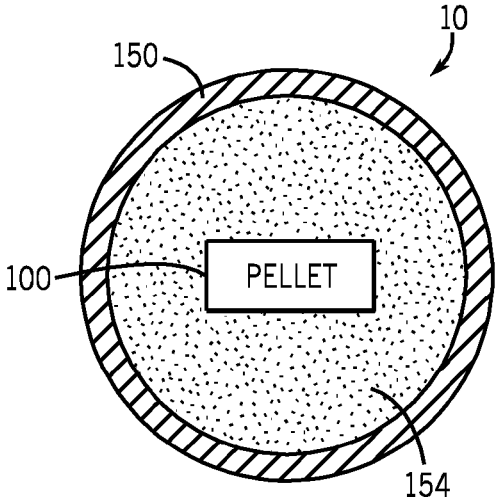
FIG. 4 is a schematic cross-sectional view taken along line 4-4 of FIG. 3 according to an example implementation.

Referring to FIG. 4 in conjunction with FIG. 3, in accordance with an example implementation, the encapsulant 140 (FIG. 3) may be formed from an inert material 154 (a material that does not react with the material of the explosive pellet housing, for example) and an outer, dissolvable layer 150. In general, the inert material 154 provides support to impart a spherical shape to the encapsulated explosive pellet 10 (cause the form factor of the encapsulated explosive pellet 10 to conform to the form factor of a ball sealer, for example), and the dissolvable, outer layer 150 of the encapsulated explosive pellet 10 surrounds the inert material 154 to provide a release mechanism i.e., a removable mechanism that allows disintegration or otherwise removal of the inert material 154 so that the inner explosive pellet 100 may be released to perform its intended downhole function.

In accordance with some implementations, the outer layer 150 is dissolvable in fracturing fluid. To prevent premature dissolving of the outer layer 150, the encapsulated explosive pellet 10 may be initially stored in a "compatible" fluid 8 (see FIG. 1) inside an interior space 11 of the ball launcher 9, in accordance with example implementations. In other words, the portion of the ball launcher 9 containing stored encapsulated explosive pellets 10 may be filled, in accordance with example implementations, with a fluid that does not dissolve or react with the outer layer 150 of the pellet 10 (i.e., the pellets 10 may be stored in a fluid in which the outer layer 150 is insoluble).

As examples, in accordance with some implementations, the inert material 154 may be one or more of the following: ceramic proppant; sand proppant; resin coated proppant; sand, in general; silica; rock salt (either potassium chloride, sodium chloride); a polymer material; or a combination of one or more of these materials. Moreover, the dissolvable outer layer 150 may be one or more of the following materials: polyacrylamide (PA); polyacrylamide copolymers; polylactic acid (PLA); polyglycolic acid (PGA) polyvinyl alcohol (PVOH); a polyvinyl alcohol copolymer; a methyl methacrylate; an acrylic acid copolymer; or any combination of one or more of these materials.

In a further implementation, the outer layer 150 may be a non-dissolvable layer, i.e., a layer that is formed from a material that does not react or dissolve in the presence of a well fluid or fluid that is introduced into the well. In this regard, for these implementations, the outer layer 150 may be removed to expose the inert material 154 by the tearing or erosion of the outer layer 150. For example, in accordance with some implementations, a restriction in well equipment (a restriction in the casing to which the fracturing fluid is pumped, for example) may be sized appropriately to restrict flow of the encapsulated explosive pellet 10.

Figure 5:
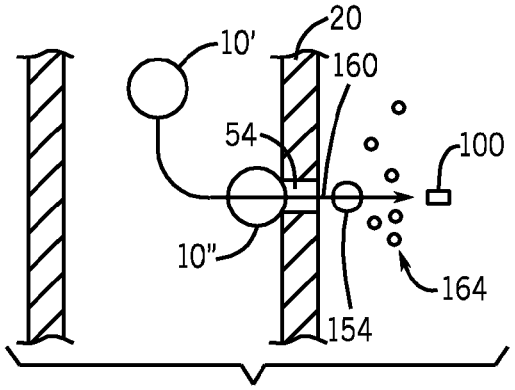
FIG. 5 is a schematic cross-sectional view of a portion of a well illustrating the use of a restriction in downhole equipment to remove an outer layer of an encapsulated explosive pellet according to an example implementation.

Thus, as depicted in FIG. 5, a given encapsulated explosive pellet 10 may flow along a flow path 160 from a position 10' to a position 10" at which the pellet 10 lodges in a casing perforation opening 54. In other words, the opening 54 has an effective inner diameter that is smaller than the outer diameter of the encapsulated explosive pellet 10. Due to the encapsulated explosive pellet 10 becoming lodged in such an opening 54, the outer layer 150 eventually tears or erodes so that the inert material 154 (without the outer layer 150) passes through the opening 54 and thereafter disintegrates as depicted at reference numeral 164, to release the inner explosive pellet 100.

The restriction to tear or erode the outer layer 150 may also be in the form of a screen that has openings that are sized smaller than the diameter of the encapsulated explosive pellet 10. Regardless of the particular form, the flow restriction retains, or holds, the encapsulated explosive pellet 10 in place while a downhole fluid flow tears or erodes the outer layer 150. In further implementations, the downhole equipment may be constructed so that an outer knife-type edge in a flow restriction serves to tear open the outer layer 150.

In further implementations, the outer layer 150 may be a non-dissolvable layer, which is eroded or torn due to the encapsulated explosive pellet 10 being sized substantially small to not pass through the perforation tunnel 50 (see FIG. 1). Therefore, for these implementations, the encapsulated explosive pellet 10 lodges in the perforation tunnel 50, until the outer layer 150 is removed, which causes the eventual release of the inner explosive pellet 100. Thus, many variations are contemplated, which are within the scope of the appended claims.

In further implementations, the outer layer 150 may be a material that has a relatively low temperature melting point. For example, in accordance with some example implementations, the outer layer 150 may be a relatively low melting-temperature polymer, which allows the release of the inert material 154 as the encapsulated explosive pellet 10 travels downhole in the wellbore where the temperature increases accordingly with depth. The polymer that forms the outer layer 150 is compatible with the fracturing fluid inside the ball launcher 9. In further implementations, the well system 10 (see FIG. 1) may include a heating element (not shown) that is disposed downstream of the ball launcher 9 for purposes of intentionally supplying sufficient heat to melt the outer layer 150, as the encapsulated explosive pellet 10 is introduced into the well.

In further implementations, the outer layer 150 may be designed to be collapsible at the pressures experienced downhole in the well. For example, in accordance with some implementations, the outer layer 150 may have a sufficient thickness to be stable for the pressure used in the ball launcher 9 but may be collapsible at higher pressures, such as the hydrostatic pressures that are present downhole in the well.

Figure 6:
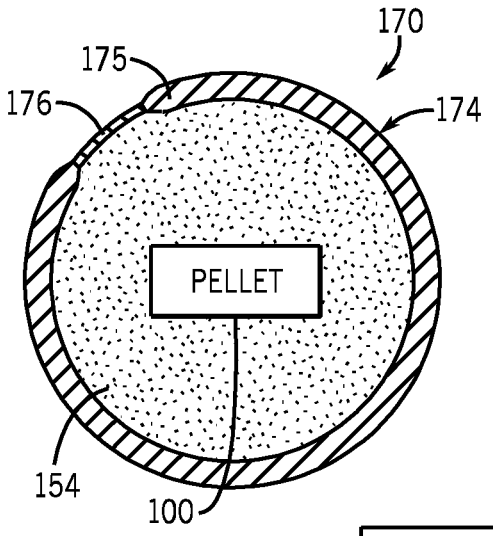
FIGS. 6, 8, 10 and 12 are schematic cross-sectional views of encapsulated explosive pellets according to further example implementations.

As a more specific example, in accordance with some implementations, an encapsulated explosive pellet 170 that is depicted in FIG. 6 may be used. The encapsulated explosive pellet 170 has the same general design as the encapsulated explosive pellet 10, with like reference numbers being used to designate similar components, except that the pellet 170 has an outer layer 174 (replacing the outer layer 150) that is formed from a non-dissolvable material 175 and has at least one rupture disk 176 (a relatively thinner portion of the material 175 or another relatively thin material, as examples) that is constructed to be breached, or rupture, at downhole pressures.

Figure 7:
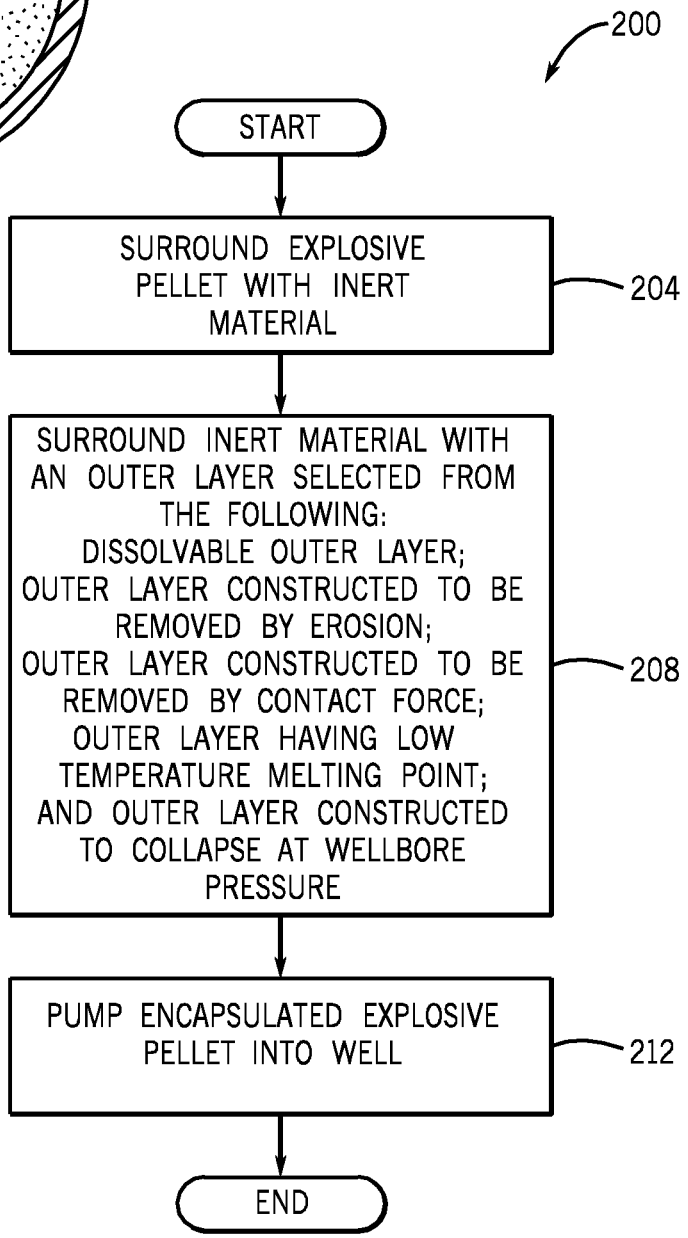
FIGS. 7, 9, 11 and 13 are flow diagrams depicting techniques to construct and use encapsulated explosive pellets according to example implementations.

Thus, referring to FIG. 7, in accordance with example implementations, a technique 200 may be used for purposes of encapsulating an explosive pellet and using the encapsulated explosive pellet in a well. Pursuant to the technique 200, an explosive pellet is surrounded (block 204) with an inert material. The inert material may be surrounded (block 208) with an outer layer that is selected from one of the following: a dissolvable outer layer; an outer layer constructed to be removed by erosion; an outer layer constructed to be removed by contact force; an outer layer having a relatively low temperature melting point; and an outer layer that is constructed to collapse at wellbore pressure. The encapsulated explosive pellet may be pumped downhole into the well, pursuant to block 212, where the encapsulant is at least partially removed to allow the explosive pellet to perform its intended function.

Figure 8:
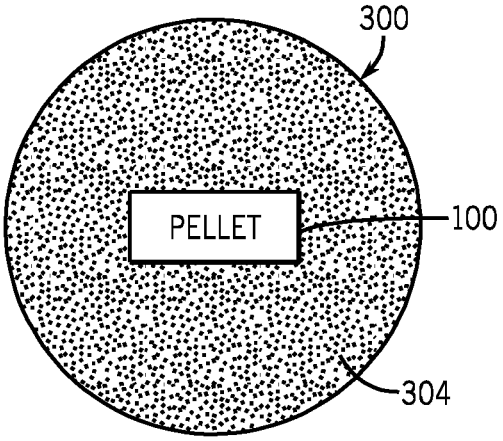

Referring to FIG. 8, in accordance with further implementations, an encapsulated explosive pellet 300 may be formed by surrounding an explosive pellet 100 with an encapsulating material 304 that encapsulates the explosive pellet 100 and is bonded together by a dissolvable binder material. For this example, the encapsulated explosive pellet 300 does not have an outer layer that surrounds the inert material 304. As an example, the encapsulating material 304 may be formed mostly of an inert material (fracturing sand, for example), which is bonded together using a dissolvable adhesive, or resin. The encapsulating material 304 may be relatively porous, so that the adhesive/resin may dissolve rapidly in the well to release the explosive pellet 100. For these implementations, the encapsulated explosive pellet 300 may be stored in the ball launcher 9 using a compatible fluid.

Figure 9:
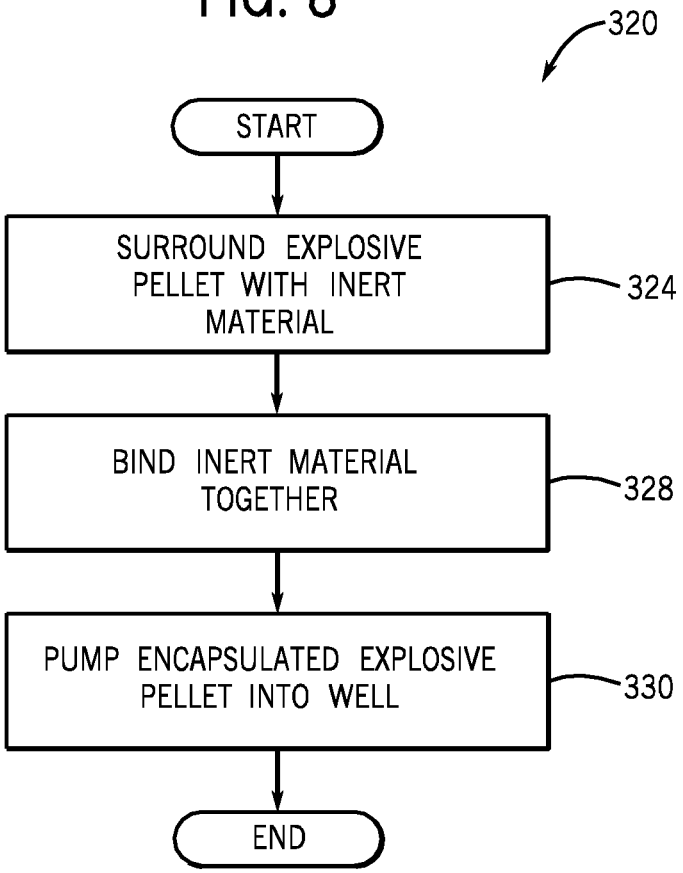

Thus, referring to FIG. 9, in accordance with an example implementation, a technique 320 includes surrounding (block 324) an explosive pellet with an inert material and holding, or bonding, the inert material together with a binder, pursuant to block 328. The resulting encapsulated explosive pellet may then be pumped into the well, pursuant to block 330.

In accordance with further implementations, the inert material 304 of FIG. 8 may be held together by a non-dissolvable material. For these implementations, the inert material, such as fracturing sand or resin-coated proppant, or a thermoplastic treated with a partial solvent, may be held together using a non-dissolvable adhesive. The resulting encapsulated mass is relatively brittle and weakly bonded and therefore, may be disaggregated to liberate the inner explosive pellet 100 when flowing through a restriction, as discussed above.

In accordance with further implementations, the inert material 304 of FIG. 8 may be held together by a dissolvable material. For these implementations, the inert material, such as fracturing sand or resin-coated proppant, or a thermoplastic treated with a partial solvent, may be held together using a dissolvable adhesive. The resulting encapsulated mass stays bonded while inside of the ball sealer launcher 9 or other device by use of a fluid 8 in which the bonding adhesive is not soluble, but the bonding adhesive begins dissolving in the well when in contact with the well fluids.

As a more specific example, in accordance with some implementations, the encapsulated explosive pellet 300 may be formed by embedding the explosive pellet 100 inside a 20/40 ceramic proppant that is coated with a resin and is placed inside a mold. Using the mold, the ceramic proppant may then be compressed to 1000 pounds per square inch (psi) and heated to 200° Fahrenheit (F) to form the encapsulated explosive pellet. As another variation, the above-described process may be used with the addition that fibers, such as polyactic acid fibers, may be added to the resin-coated ceramic proppant before the above-described application of heat and pressure. As another example, the encapsulated explosive pellet 300 may be formed by pouring a mixture of 20/40 sand and polyactic acid fibers into a mold (where the sand and fibers surround an inner explosive pellet 100) and compressing this mixture to 1000 psi. As another variation, a 20/40 ceramic proppant without a resin may be compressed in a mold about the explosive pellet 100 to 1000 psi.

Figure 10:
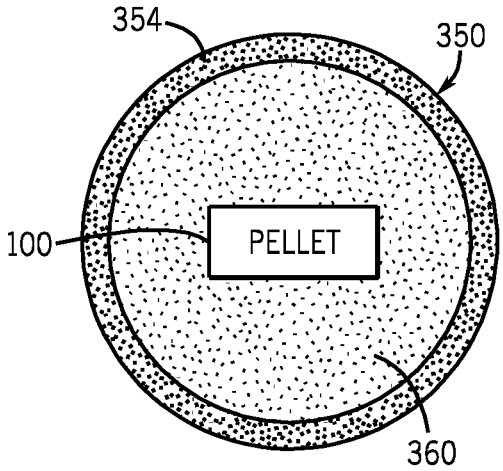

Referring to FIG. 10, in accordance with further implementations, an encapsulated explosive pellet 350 may be formed from a relatively loose inert material 360 that surrounds the explosive pellet 10. The inert material 360 is surrounded by an outer layer 354 that is formed from an inert material that is bonded together by a dissolvable material. In this manner, the material 360 may be formed mostly of an inert material, such as fracturing sand; and the outer layer 354 may be formed from fracturing sand or resin-coated proppant or a thermal plastic treated with a partial solvent, which is bonded together using a dissolvable adhesive. The resulting outer layer 354 is relatively brittle, weakly bonded and may be disaggregated to liberate the explosive pellet 100 when flowing through a restriction, as discussed above.

Figure 11:
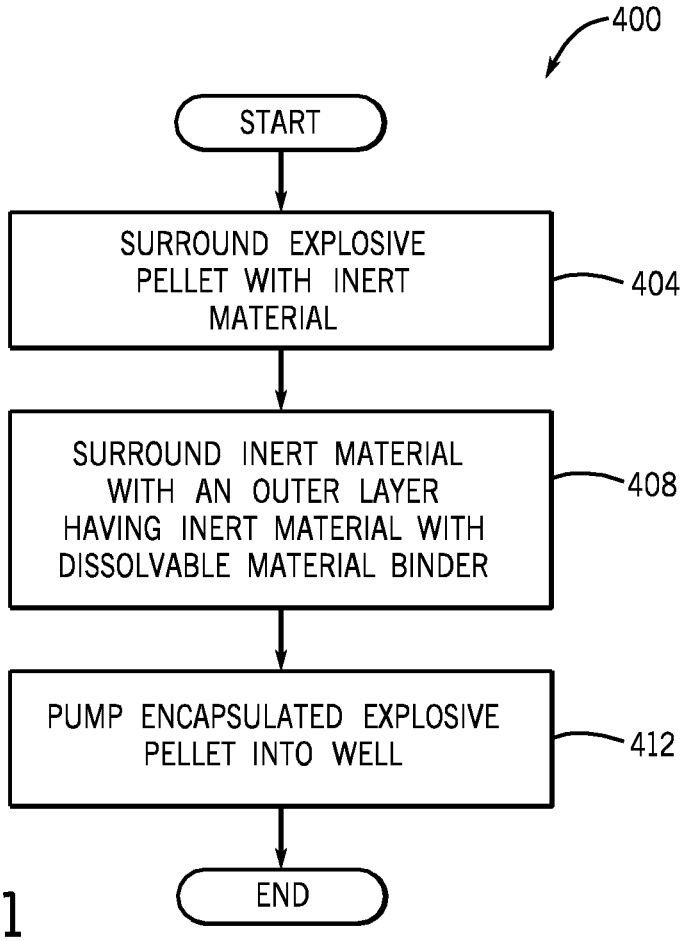

Thus, referring to FIG. 11, in accordance with some implementations, a technique 400 includes surrounding (block 404) an explosive pellet with an inert material and surrounding (block 408) the inert material with an outer layer that has an inert material with a dissolvable material. Pursuant to the technique 400, the encapsulated explosive pellet may then be pumped into the well, pursuant to block 412.

Figure 12:
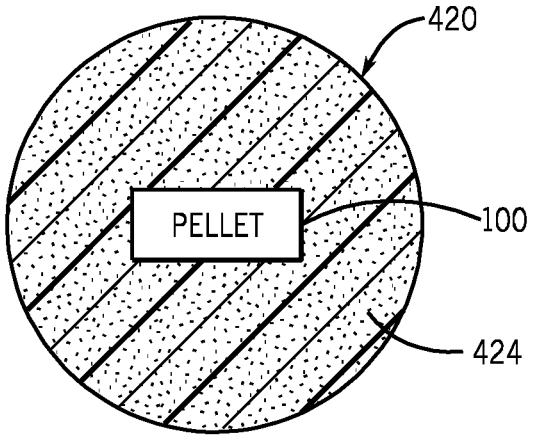

As yet another example, FIG. 12 depicts an encapsulated explosive pellet 420 in accordance with example implementations. The encapsulated explosive pellet 420 includes an explosive pellet 100 that is encapsulated by a dissolvable material 424. In this manner, when the encapsulated explosive pellet 420 is introduced into the well, the material 424 begins to dissolve. In accordance with some implementations, the encapsulated explosive pellet 420 may be stored in a compatible fluid inside the ball launcher 9.

In further implementations, the dissolvable material 424 may be any of the following materials: a surfactant, a polymer, a wax, a plasticizer, an asphalt, a resin or any combination thereof.

Figure 13:
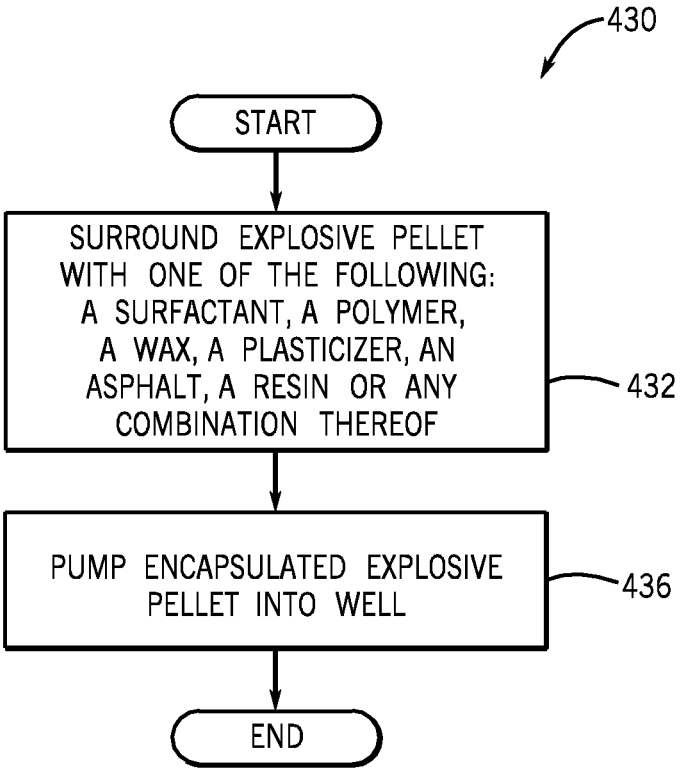

Thus, referring to FIG. 13, in accordance with example implementations, a technique 430 includes surrounding (block 432) an explosive pellet with one of the following materials: a surfactant a polymer, a wax, a plasticizer, an asphalt, a resin or any combination thereof. The technique includes pumping (block 436) the encapsulated explosive pellet into a well.

While a limited number of examples have been disclosed herein, those skilled in the art, having the benefit of this disclosure, will appreciate numerous modifications and variations therefrom. It is intended that the appended claims cover all such modifications and variations

What is claimed is:

1. An apparatus usable with a well, comprising:

an explosive pellet adapted to be communicated into the well via a fluid and comprising an explosive material adapted to be detonated downhole in a reservoir, in a fracture, or in the well; and an encapsulant to encapsulate the explosive pellet to inhibit unintended detonation of the explosive material, the encapsulant adapted to be at least partially removed from the explosive pellet in response to the explosive pellet being communicated into the well;

an inert material to surround the explosive pellet, the inert material being adapted to be removed when exposed to a downhole environment; and an outer layer to surround the inert material to prevent removal of the inert material, the outer layer being adapted to be at least partially removed in response to a contact force being exerted against the outer layer in the downhole environment.

2. The apparatus of claim 1, wherein the explosive material is adapted to be detonated downhole in at least one of the following locations: a reservoir, a fracture and another location in the well.

3. The apparatus of claim 1, wherein the encapsulant comprises:

an inert material to surround the explosive pellet, the inert material being adapted to be removed when exposed to a downhole environment; and an outer layer to surround the inert material to prevent removal of the inert material, the outer layer being adapted to at least partially dissolve in the downhole environment.

4. The apparatus of claim 3, wherein the inert material comprises at least one of the following: a sand-based proppant; a ceramic-based proppant; a resin coated proppant; sand; silica; potassium chloride and sodium chloride.

5. The apparatus of claim 3, wherein the outer layer comprises at least one of the following: a polyacrylamide; a polyacrylamide copolymer; a polylactic acid; a polyglycolic acid; a polyvinyl alcohol; a polyvinyl alcohol copolymer; and a methyl methacrylate acrylic acid copolymer.

6. The apparatus of claim 1, wherein the encapsulant comprises:

an inert material to surround the explosive pellet, the inert material being adapted to be removed when exposed to a downhole environment; and an outer layer to surround the inert material to prevent removal of the inert material, the outer layer being adapted to be at least partially removed in response to a temperature of the outer layer exceeding a melting point of the outer layer.

7. An apparatus usable with a well, comprising:

an explosive pellet adapted to be communicated into the well via a fluid and comprising an explosive material adapted to be detonated downhole in a reservoir, in a fracture or in the well;

an encapsulant to encapsulate the explosive pellet to inhibit unintended detonation of the explosive material, the encapsulant adapted to be at least partially removed from the explosive pellet in response to the explosive pellet being communicated into the well;

an inert material to surround the explosive pellet, the inert material being adapted to be removed when exposed to a downhole environment; and an outer layer to surround the inert material to prevent removal of the inert material, the outer layer being adapted to be at least partially removed in response to a downhole pressure collapsing at least a portion of the outer layer.

8. The apparatus of claim 7, wherein the outer layer comprises a rupture disc adapted to be breached into response to the downhole pressure.

9. The apparatus of claim 7, wherein the encapsulant comprises:

a binder adapted to bind the inert material together and at least partially dissolve when exposed to a downhole environment.

10. An apparatus usable with a well, comprising:

an explosive pellet adapted to be communicated into the well via a fluid and comprising an explosive material adapted to be detonated downhole in a reservoir, in a fractures or in the well;

an encapsulant to encapsulate the explosive pellet to inhibit unintended detonation of the explosive material, the encapsulant adapted to be at least partially removed from the explosive pellet in response to the explosive pellet being communicated into the well; wherein:

the encapsulant comprises an inert material adapted to surround the explosive pellet and a binder adapted to bind the inert material together; and the encapsulant is adapted to be at least partially removed in response to a contact force being exerted against the encapsulant in the downhole environment.

11. The apparatus of claim 10, wherein the encapsulant comprises:

an inert material core; and an outer layer to surround the inert material core, the outer layer comprising an inert material adapted to surround the explosive pellet and a binder adapted to bind the inert material in the outer layer together, wherein the outer layer is adapted to be at least partially removed in response to a contact force being exerted against the outer layer in the downhole environment.

12. The apparatus of claim 10, wherein the encapsulant comprises a dissolvable material.

13. The apparatus of claim 12, wherein the dissolvable material comprises at least one of a surfactant, a polymer, a wax, a plasticizer, an asphalt or a resin.

14. A method usable with a well, comprising:

pumping a fluid into the well to communicate an explosive pellet into the well;

detonating the explosive pellet downhole either in a reservoir, in a fracture, or in the well;

using an encapsulant to encapsulate the explosive pellet to inhibit unintended detonation of the explosive material; and at least partially removing the encapsulant in response to communicating the explosive pellet into the well, wherein at least partially removing the encapsulant comprises:

using a restriction provided by equipment deployed in the well to exert a contact force against the encapsulant.

15. The method of claim 14, wherein detonating the explosive pellet comprises detonating the explosive pellet in at least one of the following: in a reservoir, in a fracture, and in another location in the well.

16. The method of claim 14, wherein at least partially removing the encapsulant comprises:

at least partially dissolving the encapsulant in the downhole environment.

17. The method of claim 14, wherein at least partially removing the encapsulant comprises:

using a flow in the well to erode the encapsulant.

18. A method usable with a well, comprising:

pumping a fluid into the well to communicate an explosive pellet into the well;

detonating the explosive pellet downhole either in the reservoir, in the fractures or in the well;

using an encapsulant to encapsulate the explosive pellet to inhibit unintended detonation of the explosive material; and at least partially removing the encapsulant in response to communicating the explosive pellet into the well, wherein at least partially removing the encapsulant comprises:

using a restriction provided by a perforation tunnel to exert a contact force against the encapsulant.

19. The method of claim 18, wherein at least partially removing the encapsulant comprises:

using a restriction provided by equipment deployed in the well to exert a contact force against the encapsulant.

20. A method usable with a well, comprising:

providing a device adapted to launch ball sealers into the well;

encapsulating an explosive pellet with an encapsulant to cause the encapsulated explosive pellet to have a form factor substantially the same as a ball sealer form factor, wherein the explosive pellet comprises an explosive material adapted to be detonated downhole, and an encapsulant to encapsulate the explosive pellet to inhibit unintended detonation of the explosive material, the encapsulant adapted to be at least partially removed from the explosive pellet in response to the explosive pellet being communicated into the well, an inert material to surround the explosive pellet, the inert material being adapted to be removed when exposed to a downhole environment, and an outer layer to surround the inert material to prevent removal of the inert material, the outer layer being adapted to be at least partially removed in response to a contact force being exerted against the outer layer in the downhole environment; and using the device to communicate the explosive pellet into the well.

21. The method of claim 20, wherein the encapsulant is adapted to be removed in response reacting to a first fluid present in the well, the method further comprising using a second fluid inside the device, the second fluid being adapted to substantially not react with the encapsulant.

22. The method of claim 20, further comprising:

pumping the explosive pellet downhole; and detonating an explosive material of the explosive pellet downhole.

* * * * *